US010442216B2

(12) United States Patent
Kozuma et al.

(10) Patent No.: US 10,442,216 B2
(45) Date of Patent: Oct. 15, 2019

(54) PRINTING APPARATUS AND PRINTING METHOD

(71) Applicant: SEIKO EPSON CORPORATION, Tokyo (JP)

(72) Inventors: Itaru Kozuma, Nagano (JP); Kazuaki Sakurada, Nagano (JP); Seigo Momose, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 134 days.

(21) Appl. No.: 15/512,615

(22) PCT Filed: Oct. 14, 2015

(86) PCT No.: PCT/JP2015/005195
§ 371 (c)(1),
(2) Date: Mar. 20, 2017

(87) PCT Pub. No.: WO2016/059795
PCT Pub. Date: Apr. 21, 2016

(65) Prior Publication Data

US 2018/0229519 A1 Aug. 16, 2018

(30) Foreign Application Priority Data

Oct. 17, 2014 (JP) ..... 2014-212571

(51) Int. Cl.
*B41J 11/42* (2006.01)
*B41J 2/21* (2006.01)
(Continued)

(52) U.S. Cl.
CPC ..... *B41J 11/42* (2013.01); *B41J 2/2132* (2013.01); *B41J 19/145* (2013.01); *B41J 29/393* (2013.01)

(58) Field of Classification Search
CPC ..... B41J 11/42; B41J 19/145; B41J 29/393; B41J 2/2132; B41J 19/142; B41J 11/425
See application file for complete search history.

(56) References Cited

U.S. PATENT DOCUMENTS

2009/0058895 A1* 3/2009 Kida ..... B41J 19/145 347/8
2013/0300795 A1* 11/2013 Ogasawara ..... B41J 25/3082 347/16

FOREIGN PATENT DOCUMENTS

JP 02-293174 A 12/1990
JP 2005-125699 A 5/2005
(Continued)

OTHER PUBLICATIONS

The Extended European Search Report for the corresponding European Patent Application No. 15850162.7 dated Jun. 7, 2018.

*Primary Examiner* — Huan H Tran

(57) ABSTRACT

A printing apparatus includes a transporting section that transports a work, a printing mechanism section that has a nozzle plate that performs printing by discharging ink on the work, and a moving section that reciprocally and relatively moves the printing mechanism section in a direction intersecting the transporting direction of the work. In the printing apparatus, when the printing mechanism section moves reciprocally, printing in a forward path includes a first printing area, a second printing areas, and printing in a backward path includes a first printing area, and second printing areas. In addition, the transportation amount of the work is adjusted based on the second printing areas.

1 Claim, 5 Drawing Sheets

(51) Int. Cl.
*B41J 29/393* (2006.01)
*B41J 19/14* (2006.01)

(56) References Cited

FOREIGN PATENT DOCUMENTS

| | | | | |
|---|---|---|---|---|
| JP | 2005-335343 | A | | 12/2005 |
| JP | 2013-107320 | A | | 6/2013 |
| JP | 2013107320 | A | * | 6/2013 |
| WO | 2012/067148 | A1 | | 5/2012 |

* cited by examiner

[Fig. 1]
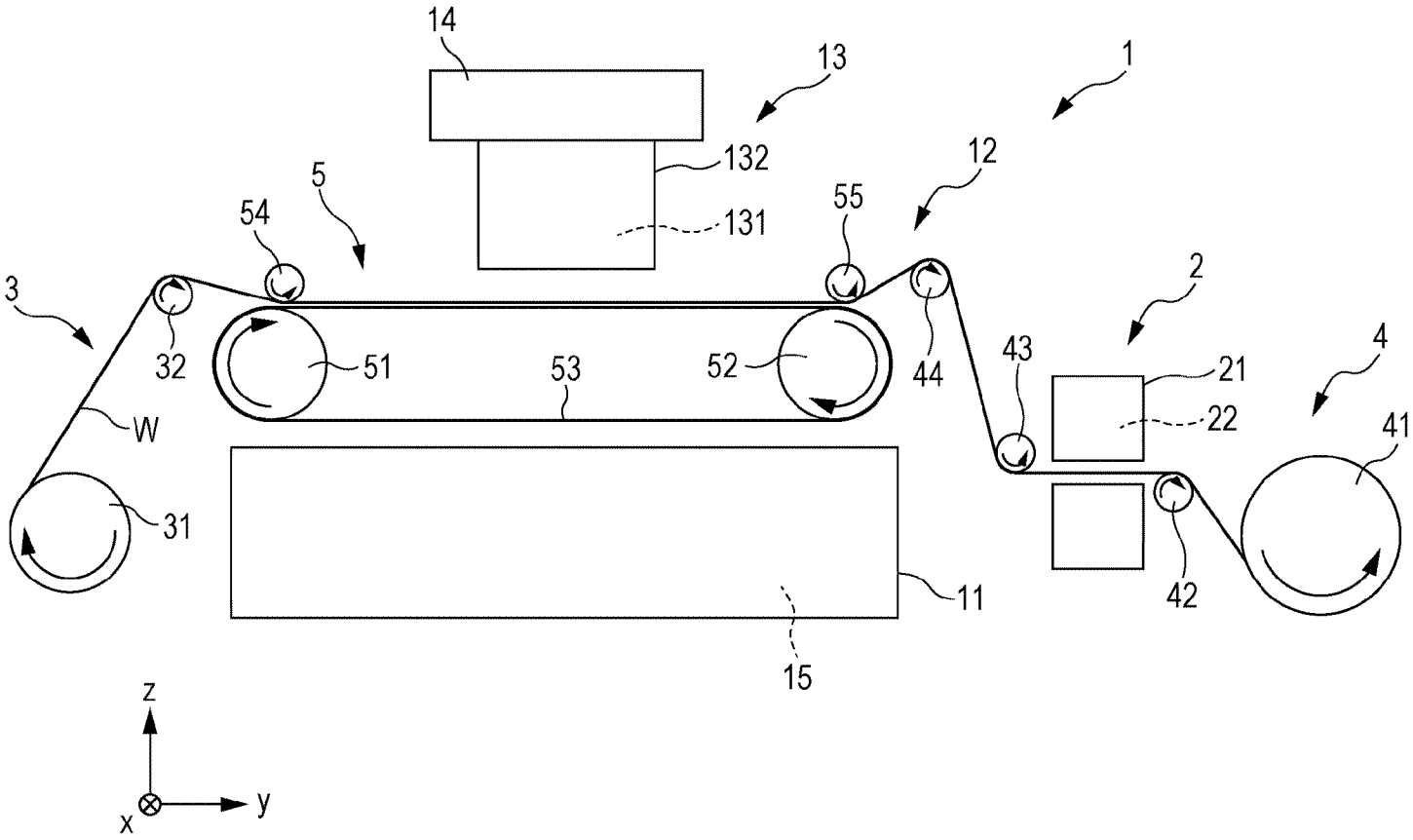

[Fig. 2]
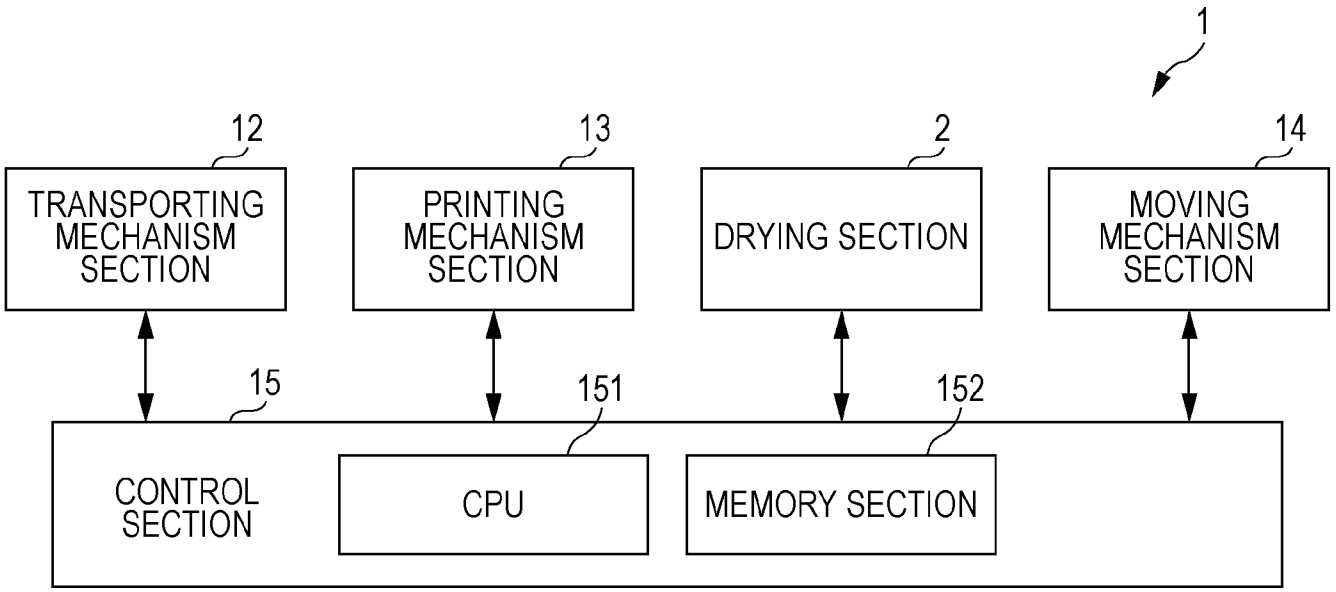

[Fig. 3]
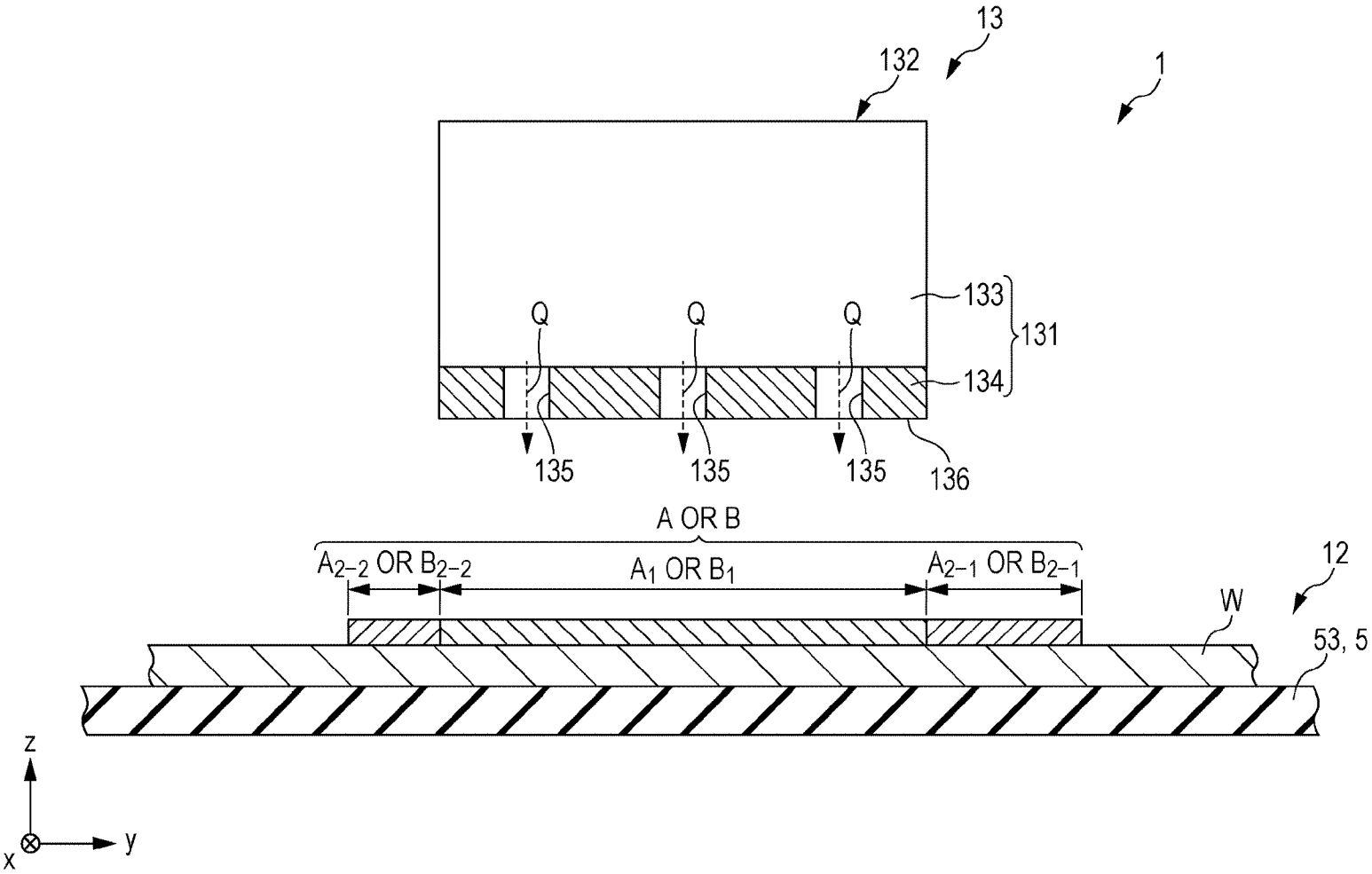

[Fig. 4A]
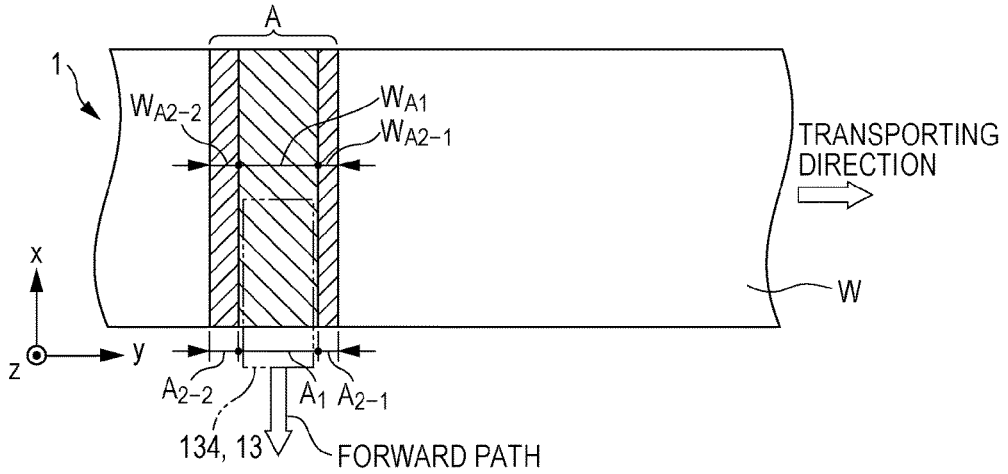
[Fig. 4B]
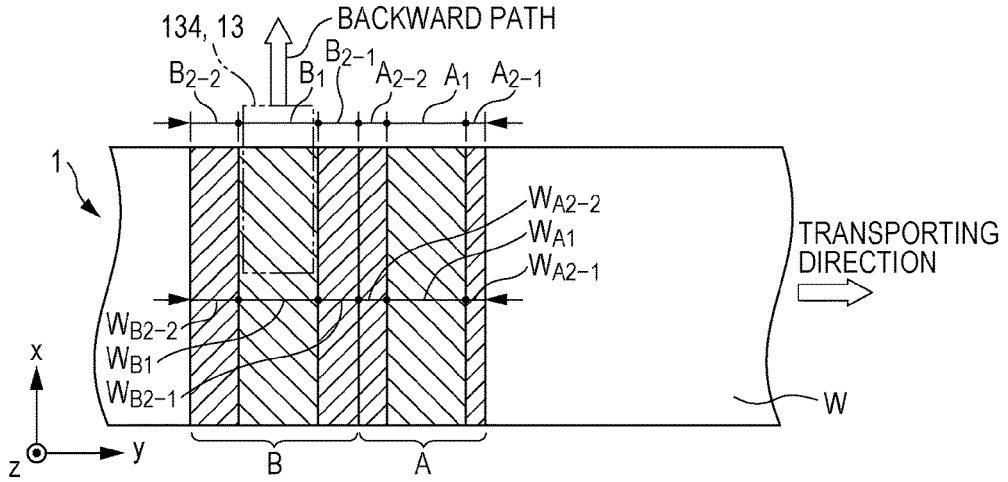
[Fig. 4C]
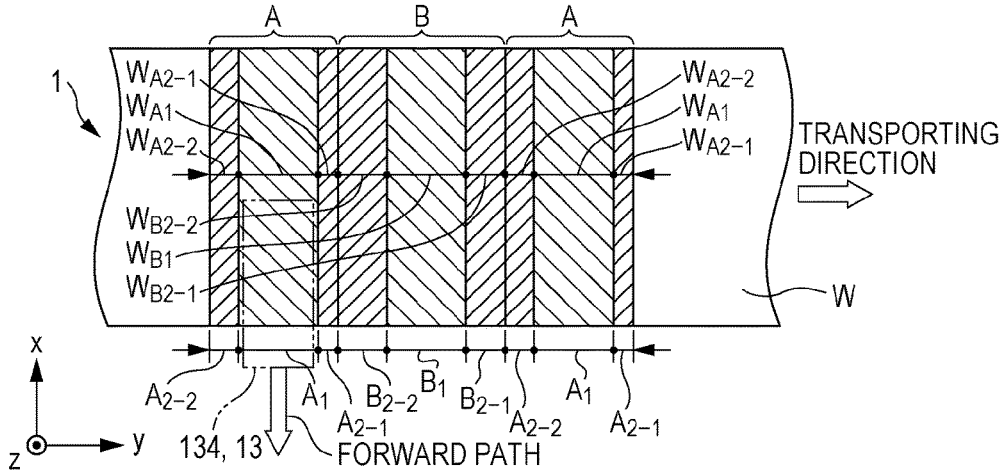

[Fig. 5]
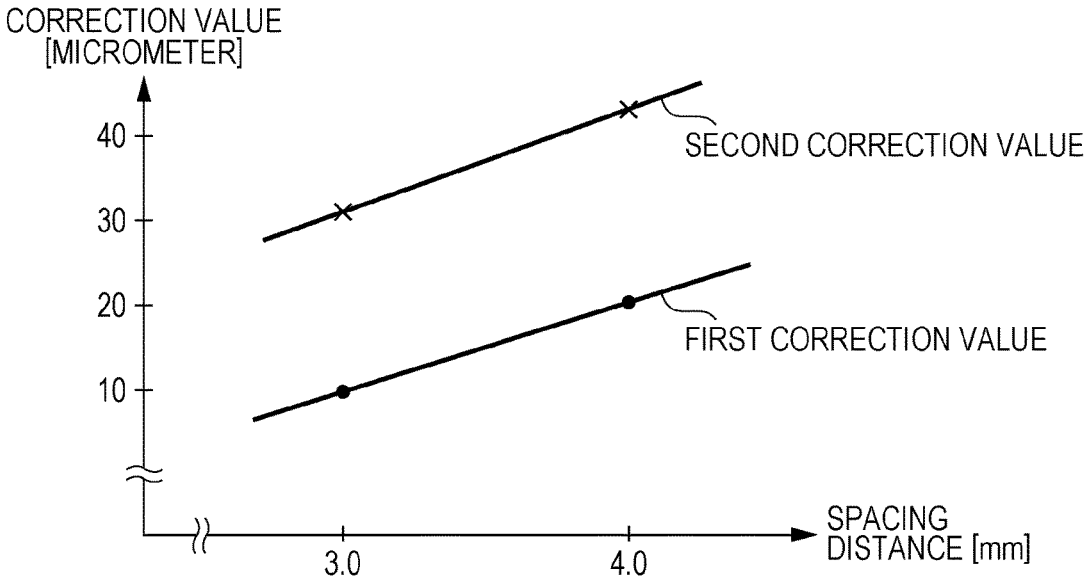
[Fig. 6]
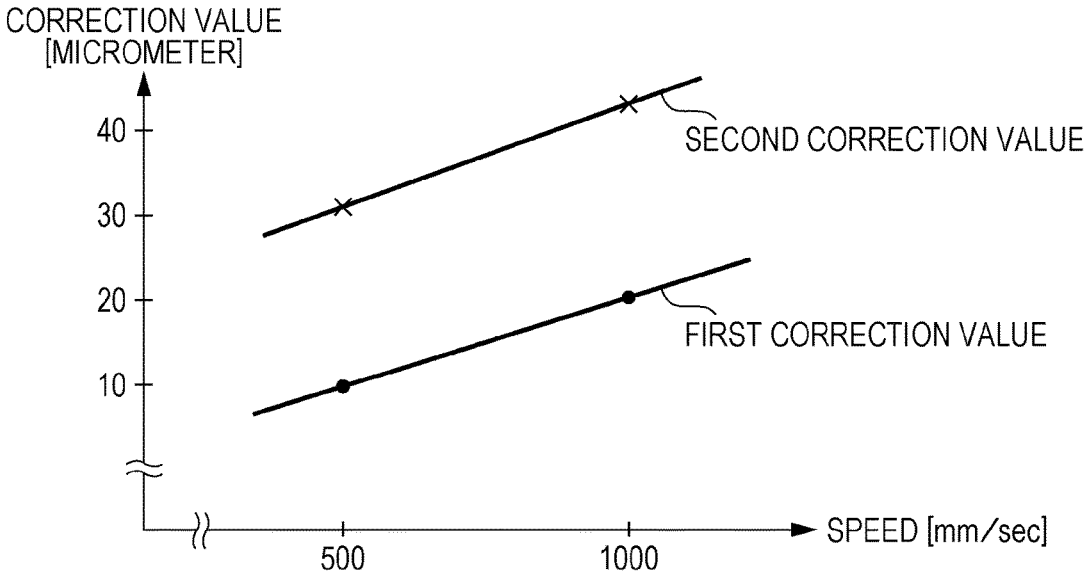

PRINTING APPARATUS AND PRINTING METHOD

CROSS-REFERENCE TO RELATED APPLICATIONS

This national phase application claims priority to Japanese Patent Application No. 2014-212571 filed on Oct. 17, 2014. The entire disclosure of Japanese Patent Application No. 2014-212571 are hereby incorporated herein by reference.

TECHNICAL FIELD

The present invention relates to a printing apparatus and a printing method.

BACKGROUND ART

There is known a printing apparatus that performs printing in an ink jet manner while transporting flexible recording medium in a belt-shape along the longitudinal direction thereof (for example, refer to PTL 1). The printing apparatus according to PTL 1 includes a carriage that has a head that discharges ink on the recording medium, and a moving mechanism that has a guide rod that supports the carriage so as to be capable of reciprocally moving along a width direction of the recording medium. In the printing apparatus according to PTL 1, as for the extent of ricketiness between the carriage and the guide rod, there has been a case where the landing position of the ink with regard to the recording medium in a forward path and a backward path of the carriage is not the desired position, and the image quality of the obtained image is lowered. For this reason, the transportation amount of the recording medium when in the forward path, and transportation amount of the recording medium when in the backward path are changed respectively to prevent decrease in the image quality.

Meanwhile, among printing apparatuses, there is a printing apparatus in which, when a carriage reciprocally moves, the printing in the forward path and the backward path respectively includes a first printing area formed at the position overlapped with the carriage from a plane view of the recording medium, and a second printing area formed, in association with the forming of the first printing area, at the position not overlapped with but deviates from the carriage adjacent to the first printing area. In such case, a problem occurs that the second printing areas in the forward path and in the backward path are overlapped with each other, the overlapped portion seems as a line, and the quality of the obtained image is lowered. Therefore, since the decrease in the image quality in this case is caused by the forming of the second printing area, it is not possible to prevent the decrease in the printing apparatus according to PTL 1.

CITATION LIST

Patent Literature

PTL 1: JP-A-2005-125699

SUMMARY OF INVENTION

Technical Problem

Accordingly, it is an object of the present invention to provide a printing apparatus and a printing method that is capable of preventing quality deterioration of an obtained image.

Solution to Problem

Such object of the invention is achieved by the invention described below.

Application Example 1

The printing apparatus according to the invention includes a transporting section that transports a recording medium, a printing section that has a nozzle plate that performs printing by discharging ink on the recording medium, and a moving section that reciprocally and relatively moves the printing section in a direction intersecting with the transporting direction of the recording medium, in which, when the printing section moves reciprocally, the printing in a forward path or in a backward path includes a first printing area formed at the position overlapped with the nozzle plate from the plane view of the recording medium, and a second printing area formed, in association with the forming of the first printing area, at any of the upstream side or the downstream side of the transporting direction with regard to the first printing area, and the transportation amount of the recording medium is adjusted based on the second printing area in the forward path or in the backward path.

As a result, the positional relationship between the second printing area in the forward path and the second printing area in the backward path are appropriately adjusted, and therefore, it is possible to prevent deterioration of the quality of an obtained image.

Application Example 2

In the printing apparatus according to the invention, it is preferable that the second printing area is formed at both sides of the upstream and downstream side of the transporting direction with regard to the first printing area, that the transporting section is configured so as to intermittently transport the recording medium, and that the transportation amount of the recording medium per one time is a sum A of a distance of the first printing area along the transporting direction and a distance of the adjacent second printing areas in the transporting direction along the transporting direction or A/n (n is an integer equal to or more than 2).

As a result, it is possible to reliably prevent the overlap between the adjacent second printing areas in the transporting direction.

Application Example 3

In the printing apparatus according to the invention, it is preferable that the overlap between the adjacent second printing areas in the transporting direction is prevented.

As a result, it is possible to absolutely prevent the occurrence of a line generated by the overlap between the adjacent second printing areas in the transporting direction.

Application Example 4

In the printing apparatus according to the invention, it is preferable that the distance of the second printing area along the transporting direction is obtained in advance.

As a result, it is possible to quickly determine the transportation amount of the recording medium and smoothly perform printing.

Application Example 5

In the printing apparatus according to the invention, in the printing section, it is preferable that the spacing distance with regard to the recording medium of the nozzle plate is changeable, and that the distance of the second printing area along the transporting direction is obtained in advance from a calibration curve indicating the relationship between the distance of the second printing area along the transporting direction and the spacing distance.

As a result, it is possible to quickly determine the transportation amount of the recording medium in accordance with the spacing distance and smoothly perform printing.

Application Example 6

In the printing apparatus according to the invention, it is preferable that the moving section is configured so that the speed when the printing section is reciprocally moved is changeable, and that the distance of the second printing area along the transporting direction is obtained in advance from a calibration curve indicating the relationship between the distance of the second printing area along the transporting direction and the speed.

As a result, it is possible to quickly determine the transportation amount of the recording medium in accordance with the speed and smoothly perform printing.

Application Example 7

A printing method according to the invention includes using a transporting section that transports recording medium, a printing section that has a nozzle plate that performs printing by discharging ink on the recording medium, and a moving section that reciprocally and relatively moves at least the nozzle plate of the printing section in a direction intersecting with the transporting direction of the recording medium, in the printing method, when the nozzle plate is reciprocally moved, the printing section in the forward path and in the backward path include a first printing area formed at the position overlapped with the nozzle plate from the plane view of the recording medium, and a second printing area formed, in association with the forming of the first printing area, at any of the upstream side or the downstream side of the transporting direction with regard to the first printing area, and the printing method further includes adjusting the transportation amount of the recording medium based on the second printing area in the forward path or in the backward path.

As a result, the positional relationship between the second printing area in the forward path and the second printing area in the backward path are appropriately adjusted, and therefore, it is possible to prevent deterioration of the quality of an obtained image.

BRIEF DESCRIPTION OF DRAWINGS

FIG. 1 is a side view that illustrates a first embodiment of a printing apparatus according to the invention.

FIG. 2 is a block view of a major part of the printing apparatus illustrated in FIG. 1.

FIG. 3 is a partial cross-sectional side view of the portion illustrating printing status of the printing apparatus in FIG. 1.

FIG. 4A is a plane view that illustrates the printing status of the printing apparatus in FIG. 1.

FIG. 4B is a plane view that illustrates the printing status of the printing apparatus in FIG. 1.

FIG. 4C is a plane view that illustrates the printing status of the printing apparatus in FIG. 1.

FIG. 5 is a calibration curve that is stored in a control section embedded in the printing apparatus according to the invention (a second embodiment).

FIG. 6 is a calibration curve that is stored in a control section embedded in the printing apparatus according to the invention (a third embodiment).

DESCRIPTION OF EMBODIMENTS

Hereinafter, the printing apparatus and the printing method according to the invention will be described in detail based on suitable embodiments illustrated in the attached drawings.

First Embodiment

FIG. 1 is a side view that illustrates a first embodiment of a printing apparatus according to the invention. FIG. 2 is a block view of a major part of the printing apparatus illustrated in FIG. 1. FIG. 3 is a partial cross-sectional side diagram of the portion illustrating printing status of the printing apparatus in FIG. 1. FIGS. 4A to 4C are plane views that illustrates the printing status of the printing apparatus in FIG. 1. Meanwhile, hereinafter, for the sake of convenience of description, a direction towards the depth of paper in FIG. 1 is referred to as an "x axis direction", a lateral direction as a "y axis direction", and a vertical direction as a "z axis direction". Moreover, coordination axes in FIG. 3 respectively correspond to coordination axes in FIG. 1.

A printing apparatus 1 according to the invention is an apparatus that performs the printing method according to the invention. As illustrated in FIGS. 1 and 2, the printing apparatus 1 includes a machine stand 11, a transporting mechanism section (transporting section) 12 that transports work W as a recording medium, a printing mechanism section (printing section) 13 that performs printing by adding ink Q on the work W, a moving mechanism section (moving section) 14 that reciprocally moves a carriage unit 132 of the printing mechanism section 13 relatively in a direction intersecting with the transporting direction of the work W, a drying section 2 that dries the ink Q on the work W, and a control section 15 that controls each of the operation of each part.

In this embodiment, a direction intersecting with the transporting direction of transporting the work W is the x axis direction, a direction parallel to the transporting direction is the y axis direction, and a direction intersecting with the x axis direction and the y axis direction is the z axis direction.

The transporting mechanism section 12 includes a delivering device 3 that sends out the long work W wound in a roll shape, a winding device 4 that winds the work W on which printing is completed, and a supporting device 5 which is arranged on the machine stand 11 and supports the work W when printing.

The delivering device 3 is arranged at the upstream side of the sending direction (y axis direction) of the work W further than the machine stand 11. The delivering device 3 includes an feeding roller (delivering reel) 31 that winds the work W in a roll shape and sends out the work W, and a tensioner 32 that applies tension on the work W between the feeding roller 31 and the supporting device 5. To the feeding roller 31, motors (not illustrated) are coupled, so that it is possible for the feeding roller 31 to rotate by the operation of the motors.

Meanwhile, as for the work W, it is possible to use a work with ink absorbency in a thin film shape, and a work with non-ink absorbency in a thin film shape. The case of the former, for example, includes paper exclusive for ink jet recording such as plain paper, fine quality paper, or glossy paper, or woven fabric, or the like. The case of the latter includes, for example, plastic film exclusive for ink jet recording on which surface treatment is not performed (that is, on which ink absorbent layer is not formed) along with base material such as paper which is coated with plastic or on which plastic film is adhered. The plastic is not specifically limited. However, the plastic includes, for example, polyvinyl chloride, polyethylene-terephthalate, polycarbonate, polystyrene, polyurethane, polyethylene, and polypropylene.

The winding device 4 is arranged at the downstream side of the sending direction (y axis direction) of the work W further than the machine stand 11 with regard to the delivering device 3. The winding device 4 includes a winding roller (winding reel) 41 that winds the work W in a roll shape, and tensioners 42, 43, and 44 that apply tension on the work W between the winding roller 41 and the supporting device 5. To the winding roller 41, motors (not illustrated) are coupled, so that it is possible for the winding roller 41 to rotate by the operation of the motors. Tensioners 42 to 44 are respectively arranged in turn with spacing between each other in a direction away from the winding roller 41.

The supporting device 5 is arranged between the delivering device 3 and the winding device 4. The supporting device 5 includes a main drive roller 51 and a driven roller 52 that are arranged being spaced from each other in the y axis direction, an endless belt 53 stretched over the main drive roller 51 and the driven roller 52, and tensioners 54 and 55 that apply tension on the work W between the main drive roller 51 and the driven roller 52.

To the main drive roller 51, motors (not illustrated) are coupled, so that it is possible for the main drive roller 51 to rotate by the operation of the motors. In addition, in the driven roller 52, the rotational force of the main drive roller 51 is transmitted through the endless belt 53, so that it is possible for the driven roller 52 to rotate being interlocked with the main drive roller 51.

The endless belt 53 is a belt on the surface of which an adhesive layer with adhesiveness is formed. On this adhesive layer, a portion of the work W is adhered and fixed, and is transported in the y axis direction. In addition, during the transportation, printing is performed on the work W. Moreover, after the printing is performed, the work W separates from the endless belt 53.

The tensioners 54 and 55 are also arranged being spaced from each other in the y axis direction as in the main drive roller 51 and the driven roller 52.

The tensioner 54 is capable of inserting the work W with the endless belt 53 between the tensioner 54 and the main drive roller 51, and the tensioner 55 is capable of inserting the work W with the endless belt 53 between the tensioner 55 and the driven roller 52. As a result, the work W applied with tension by the tensioners 54 and 55 is transported as fixed to the endless belt 53 in a state of being applied with the tension. As a result of this state, the work W is prevented from being wrinkled or the like during the transportation, and therefore, in the case of performing printing, the printing is performed accurately in a high quality.

As illustrated in FIG. 3, the printing mechanism section 13 includes a carriage unit 132 that has a plurality of ink jet heads 131 that performs recording by the printing by discharging the ink Q on the work W. Each of the ink jet heads 131 respectively includes, for example, a head main body 133 in which a head inner flow path (not illustrated) filled with the ink Q is formed, and a nozzle plate 134 that has a nozzle surface 136 in which a plurality of discharging nozzles 135 open.

In the head main body 133, piezo voltage elements respectively corresponding to each discharging nozzle are configured, and, when voltage is applied to the piezo voltage element, the ink Q is discharged as a liquid drop from the discharging nozzle 135.

Meanwhile, it is preferable that each discharging nozzle 135 is arranged in a matrix shape along the xy surface, that is the surface direction of the nozzle surface 136.

In the printing apparatus 1, an intermittent feed (sub-scanning) is performed in the y axis direction while the work W delivered by the delivering device 3 is in the fixed state of being adhered and fixed, and, with regard to the work W in the fixed state, the ink Q is discharged from the ink jet head 131 while the carriage unit 132 is reciprocally moved (main scanning) in the x axis direction (refer to FIGS. 4A to 4C). By the main scanning and the sub-scanning repeated by turns, printing is performed on the work W, that is, an image is formed. Meanwhile, this image may be a result of multi-colored printing (color printing), and also may be a result of single-colored printing.

In the ink Q, for example, four colors of cyan (C), magenta (M), yellow (Y), and black (K) are provided in which a dye or a pigment as a coloring agent is contained in water as a solvent. In addition, ink of each color is respectively and independently discharged from the ink jet heads 131.

The moving mechanism section 14 is a mechanism that is capable of reciprocally moving the carriage unit 132 along the x axis direction, and is capable of, for example, having a configuration including a linear guide, a ball screw, or a motor.

As illustrated in FIG. 1, the drying section 2 is at the downstream side of the transporting direction of the work W further than the printing mechanism section 13, and is arranged between the supporting device 5 and the winding roller 41 of the winding device 4. The drying section 2 includes a chamber 21 and a coil 22 as a heating body arranged inside the chamber 21. The coil 22 is electrically coupled to the AC power supply that is an outer power source (not illustrated). The coil 22 is, for example, configured by a nichrome wire, and is cable of generating heat by being supplied with the power from the AC power supply. In addition, by the heat, it is possible to dry the ink Q on the work W passing through the chamber 21.

The control section 15 is electrically coupled to the transporting mechanism section 12, printing mechanism section 13, the drying section 2, and the moving mechanism section 14, and has a function of controlling each of the operation of the above sections. As illustrated in FIG. 2, the control section 15 includes a central processing unit (CPU) 151 and a storing section 152.

The CPU 151 executes a program for various processing such as a printing processing as described above.

The storing section 152 includes, for example, an electrically erasable programmable read-only memory (EEPROM), which is a kind of a nonvolatile semiconductor memory, or the like, and is capable of storing various programs or the like.

As described above, when performing printing on the work W, the ink Q is discharged from the ink jet heads 131 while the carriage unit 132 is reciprocally moved in the x axis direction. In addition, in this embodiment, in the case of such reciprocal movement, printing in forward path A as illustrated in FIGS. 4A and 4(*c*) is performed in the forward path, and printing in return route B as illustrated in FIG. 4B is performed in the backward path.

The printing in forward path A is capable of being divided into a first printing area $A_1$, a second printing area $A_{2-1}$, and a second printing area $A_{2-2}$. The first printing area $A_1$ is a printing area in a belt shape formed at the position overlapped with the nozzle plate 134 from the plane view of the work W. The second printing area $A_{2-1}$ is a printing area in a belt shape formed in association with the formation of the first printing area $A_1$, and formed adjacent to the downstream side of the transporting direction with regard to the first printing area $A_1$. The second printing area $A_{2-2}$ is a printing area in a belt shape formed in association with the formation of the first printing area $A_1$, and formed adjacent to the upstream side of the transporting direction with regard to the first printing area $A_1$.

In addition, as in the printing in forward path A, the printing in backward path B is also capable of being divided into a first printing area $B_1$, a second printing area $B_{2-1}$, and a second printing area $B_{2-2}$. The first printing area $B_1$ is a printing area in a belt shape formed at the position overlapped with the nozzle plate 134 from the plane view of the work W. The second printing area $B_{2-1}$ is a printing area in a belt shape formed in association with the formation of the first printing area $B_1$, and formed adjacent to the downstream side of the transporting direction with regard to the first printing area $B_1$. The second printing area $B_{2-2}$ is a printing area in a belt shape formed in association with the formation of the first printing area $B_1$, and formed adjacent to the upstream side of the transporting direction with regard to the first printing area $B_1$.

The first printing areas $A_1$ and $B_1$ are respectively printing areas that contribute to obtaining an originally desired image.

Meanwhile, the second printing areas $A_{2-1}$, $A_{2-2}$, $B_{2-1}$, and $B_{2-2}$ are respectively a printing area (ink emission area) generated by the ink Q landing on the work W by, for example, a flight curve of the ink Q, and would be originally a portion restrained from being formed as much as possible. In addition, for example, in the case where the intermittent feed amount of the work W per one time of the sub-scanning, that is, the transportation amount per one time of the work W is set only for a width of the first printing area $A_1$ (same with the first printing area $B_1$), the adjacent second printing area $A_{2-2}$ and the second printing area $B_{2-1}$ in the transporting direction are overlapped. As in the case, the adjacent second printing area $B_{2-2}$ and the second printing area $A_{2-1}$ in the transporting direction are also overlapped. In a case where the overlap occurs, the overlapped part seems as a line, and a defect is generated that the quality of the obtained image is lowered. Here, "width" is a distance along the transporting direction of the work W. Meanwhile, in FIGS. 4A to 4C, the widths of the second printing areas $A_{2-1}$, $A_{2-2}$, $B_{2-1}$, and $B_{2-2}$ are illustrated being exaggerated compared to the widths of the first printing areas $A_1$ or $B_1$.

However, the printing apparatus 1 is configured so as to reliably prevent the decrease in image quality. Hereinafter, the configuration will be described.

A width $W_{A1}$ of the first printing area $A_1$ and a width $B_1$ of the first printing area $B_1$ are obtained in advance and are stored in the storing section 152 of the control section 15. In addition, in the printing apparatus 1, by various conditions for a printing operation, unevenness exists between the widths of the second printing areas $A_{2-1}$, $A_{2-2}$, $B_{2-1}$, and $B_{2-2}$ respectively at the forward path and the backward path, that is, the widths differ. In addition, a width $W_{A2-1}$ of the second printing area $A_{2-1}$, a width $W_{A2-2}$ of the second printing area $A_{2-2}$, a width $W_{B2-1}$ of the second printing area $B_{2-1}$, and a width $W_{B2-2}$ of the second printing area $B_{2-2}$ are also obtained in advance and are stored in the storing section 152 of the control section 15. A method of obtaining each width is not specifically limited, and the method includes, for example, performing test printing on the work W and measures each width.

First, as illustrated in FIG. 4A, the printing mechanism section 13 is moved in one direction of the x axis direction with the work W in a stopped state. As a result, the printing in forward path A is formed on the work W.

Next, as illustrated in FIG. 4B, the work W is intermittently fed and transported. The transportation amount per one time is the sum of the width $W_{A1}$ of the first printing area $A_1$ and the width $W_{A2-2}$ of the second printing area $A_{2-2}$, and width $W_{B2-1}$ of the second printing area $B_{2-1}$ that is adjacent to the second printing area $A_{2-2}$ and formed thereby. In addition, after the transportation of the work W is stopped, the printing mechanism section 13 is moved in the direction opposite to the above direction. As a result, the printing in return route B is formed on the work W. Here, the second printing area $B_{2-1}$ in the printing in return route B is formed in a state in which the overlap between the second printing area $B_{2-1}$ and the adjacent second printing area $A_{2-2}$ is prevented. As a result, it is possible to prevent a "line" generated by the overlap between the second printing areas $A_{2-2}$ and $B_{2-1}$.

Next, as illustrated in FIG. 4C, the work W is intermittently fed and transported again. The transportation amount per one time in this time is the sum of the width $W_{B1}$ of the first printing area B1, the width $W_{B2-2}$ of the second printing area $B_{2-2}$, the width $W_{A2-1}$ of the second printing area $A_{2-1}$ that is adjacent to the second printing area $B_{2-2}$ and formed thereby. In addition, after the transportation of the work W is stopped, the printing mechanism section 13 is moved in the one direction. As a result, the printing in forward path A is formed on the work W. Here, the second printing area $A_{2-1}$ in the printing in forward path A is formed in a state in which the overlap between the second printing area $A_2$ and the adjacent second printing area $B_{2-2}$ is prevented. As a result, it is possible to prevent a "line" generated by the overlap between the second printing areas $B_{2-2}$ and $A_{2-1}$.

As in the above, in the printing apparatus 1, based on the second printing areas $A_{2-1}$ and $A_{2-2}$ in the forward path and the second printing areas $B_{2-1}$ and $B_{2-2}$ in the backward path, correction values that adjust the transportation amounts of the work W are respectively determined in the forward path and in the backward path. The "correction value" is a value regarding, in the transportation amount per one time of the work W, with regard to the width $W_{A1}$ of the first printing area $A_1$ or the width $W_{B1}$ of the first printing area $B_1$, the extent of increase that the overlap between the second printing areas is prevented. In the state illustrated in FIG. 4B, the sum of the width $W_{A2-2}$ of the second printing area $A_{2-2}$ and the width $W_{B2-1}$ of the second printing area $B_{2-1}$ corresponds to the correction value (hereinafter referred to as "a first correction value"). In the state illustrated in FIG. 4C, the sum of the width $W_{B2-2}$ of the second printing area $B_{2-2}$ and the width $W_{A2-1}$ of the second printing area $A_{2-1}$ corresponds to the correction value (hereinafter referred to as "a second correction value").

By the first and second correction values, it is possible to reliably prevent the generation of a line both in the forward path and the backward path, and therefore, it is possible to prevent quality deterioration of the obtained image.

In addition, as described above, the widths of the second printing areas $A_{2-1}$, $A_{2-2}$, $B_{2-1}$, and $B_{2-2}$ are obtained in advance. As a result, it is possible to quickly determine the first correction value and the second correction value, and smoothly perform printing.

Second Embodiment

FIG. 5 is a calibration curve that is stored in a control section embedded in the printing apparatus according to the invention (a second embodiment).

Hereinafter, a second embodiment of the printing apparatus and the printing method according to the invention will be described with reference to the drawing. However, the description will focus on points different from the above described embodiment, and the description of the shared contents will be omitted.

This embodiment is the same as the first embodiment except for that the correction value is different.

In this embodiment, a printing mechanism section 13 is configured so that the spacing distance of a nozzle surface 136 of a nozzle plate 134 with regard to a work W is changeable. This configuration is not specifically limited, and the configuration includes, for example, a supporting mechanism that has a linear guide, a ball screw, a motor, or the like, and supports the printing mechanism section 13 so as to be moved in a z axis direction.

In addition, depending on the length of the spacing distance as well, the widths of second printing areas $A_{2-1}$, $A_{2-2}$, $B_{2-1}$, and $B_{2-2}$ differ.

The correction value based on the widths of the second printing areas $A_{2-1}$, $A_{2-2}$, $B_{2-1}$, and $B_{2-2}$ is obtained in advance by the calibration curve (refer to FIG. 5) illustrating the relationship between the correction value and the spacing distance. As a result, it is possible to quickly determine the first correction value and the second correction value in accordance with the spacing distance, and smoothly perform printing. Meanwhile, the calibration curve is stored in advance in a storing section 152 of a control section 15.

For example, in the case where the spacing distance is 3.0 micrometer, a first correction value is 10 mm, and a second correction value is 30 micrometer. In addition, in the case where the spacing distance is 4.0 mm, the first correction value is 20 micrometer, and the second correction value is 40 micrometer.

Third Embodiment

FIG. 6 is a calibration curve that is stored in a control section embedded in the printing apparatus according to the invention (a third embodiment).

Hereinafter, a third embodiment of the printing apparatus and the printing method according to the invention will be described with reference to the drawing. However, the description will focus on points different from the above described embodiment, and the description of the shared contents will be omitted.

This embodiment is the same as the first embodiment except for that the correction value is different.

In this embodiment, a moving mechanism section 14 is configured so that the speed of reciprocally moving a carriage unit 132 is changeable. This configuration is not specifically limited, and the configuration may include a configuration in which the moving mechanism section 14 includes a reduction device.

In addition, depending on the extent of the speed as well, the widths of second printing areas $A_{2-1}$, $A_{2-2}$, $B_{2-1}$, and $B_{2-2}$ differ.

The correction value based on the widths of the second printing areas $A_{2-1}$, $A_{2-2}$, $B_{2-1}$, and $B_{2-2}$ is obtained by the calibration curve (refer to FIG. 6) illustrating the relationship between the correction value and the speed. As a result, it is possible to quickly determine the first correction value and the second correction value in accordance with the speed, and smoothly perform printing. Meanwhile, the calibration curve is stored in advance in a storing section 152 of a control section 15.

For example, in the case where the speed is 500 mm/sec, a first correction value is 10 micrometer, and a second correction value is 30 micrometer. In addition, in the case where the speed is 1000 mm/sec, the first correction value is 20 micrometer, and the second correction value is 40 micrometer.

In the above, the embodiments of the printing apparatus and the printing method according to the invention are described with reference to the drawings. However, the invention is not limited to these embodiments, and each part configuring the printing apparatus may be replaced with any configuration that can show the same function. In addition, any configuration component may be added.

Moreover, the printing apparatus and the printing method according to the invention may be a combination of any two or more configurations (characteristics) among each of the embodiments. For example, when determining the first correction value and the second correction value, both of the calibration curves illustrated in FIG. 5 and FIG. 6 may be used to perform the determination.

In addition, in each of the embodiments, the printing in forward path and the printing in return route respectively include the first printing area and the second printing area formed at both the upstream side and the downstream side of the transporting direction with regard to the first printing area, however are not limited thereto. For example, by various conditions such as a condition for ink discharging, in some cases, the printing in forward path and the printing in return route respectively may include the first printing area and the second printing area formed at only one of the upstream side and the downstream side of the transporting direction with regard to the first printing area. Also in such case, according to the invention, it is possible to prevent quality deterioration of the obtained image.

In the above embodiments, the case of so-called band printing in which printing is performed so that the respective printing areas of the printing in forward path and the printing in return route do not overlap is described. However, the case of multi-pass printing in which printing is performed while a part of the printing areas of the printing in forward path and the printing in return route overlap may also be applied. For example, in the case of n pass printing (n is an integer equal to or more than 2), as described with the case illustrated in FIG. 4B, the transportation amount per one time is 1/n of the sum of the width $W_{A1}$ of the first printing area A1, the width $W_{A2-2}$ of the second printing area $A_{2-2}$, and the width $W_{B2-1}$ of the second printing area $B_{2-1}$ that is adjacent to the second printing area $A_{2-2}$ and formed thereby.

In the above embodiments, the printing in both directions in which the printing in forward path and the printing in return route are alternately performed is described. However, the case of single-direction printing (either the printing in forward path or the printing in return route is not performed) may be applied. In this case, the printing direction in FIG. 4B may be applied by being replaced with the forward path direction, and, as described with the case illustrated in FIG. 4B, the transportation amount per one time is the sum of the width $W_{A1}$ of the first printing area $A_1$, the width $W_{A2-2}$ of the second printing area $A_{2-2}$ and width $W_{A2-1}$ of the second printing area $A_{2-1}$ that is adjacent to the second printing area $A_{2-2}$ and formed thereby.

REFERENCE SIGNS LIST

1 PRINTING APPARATUS
11 MACHINE STAND
12 TRANSPORTING MECHANISM SECTION (TRANSPORTING SECTION)
13 PRINTING MECHANISM SECTION (STORING SECTION)
131 INK JET HEAD
132 CARRIAGE UNIT
133 HEAD MAIN BODY
134 NOZZLE PLATE
135 DISCHARGING NOZZLE
136 NOZZLE SURFACE
14 MOVING MECHANISM SECTION (MOVING SECTION)
15 CONTROL SECTION
151 CENTRAL PROCESSING UNIT (CPU)
152 STORING SECTION
2 DRYING SECTION
21 CHAMBER
22 COIL
3 DELIVERING DEVICE
31 FEEDING ROLLER (DELIVERING REEL)
32 TENSIONER
4 WINDING DEVICE
41 WINDING ROLLER (WINDING REEL)
42, 43, 44 TENSIONER
5 SUPPORTING DEVICE
51 MAIN DRIVE ROLLER
52 DRIVEN ROLLER
53 ENDLESS BELT
54, 55 TENSIONER
A PRINTING IN FORWARD PATH
$A_1$ FIRST PRINTING AREA
$A_{2-1}$, $A_{2-2}$ SECOND PRINTING AREA
B PRINTING IN RETURN ROUTE
$B_1$ FIRST PRINTING AREA
$B_{2-1}$, $B_{2-2}$ SECOND PRINTING AREA
Q INK
W WORK
$W_{A1}$, $W_{A2-1}$, $W_{A2-2}$, $W_{B1}$, $W_{B2-1}$, $W_{B2-2}$ WIDTH

The invention claimed is:

1. A printing method comprising:

using a transporting section that transports a recording medium, a printing section that includes a nozzle plate that performs printing by discharging ink on the recording medium, and a moving section that reciprocally and relatively moves at least the nozzle plate of the printing section in a direction intersecting with the transporting direction of the recording medium, wherein, when the nozzle plate is moved reciprocally, the printing at a forward path or at a backward path includes a first printing area formed at the position overlapped with the nozzle plate in the transporting direction when viewed from a plane view of the recording medium, and a second printing area formed adjacent to the first printing area on at least any of the upstream side or the downstream side of the transporting direction with regard to the first printing area, and a transportation amount of the recording medium is adjusted based on a distance of the second printing area along the transporting direction in the forward path or in the backward path using a first correction value and a second correction value, the first correction value corresponding to a sum of a distance of the second printing area formed on the upstream side with regard to the first printing area along the transporting direction and a distance of the second printing area formed on the downstream side with regard to the first printing area along the transporting direction during the printing at the forward path, the second correction value corresponding to a sum of a distance of the second printing area formed on the upstream side with regard to the first printing area along the transporting direction and a distance of the second printing area formed on the downstream side with regard to the first printing area along the transporting direction during the printing at the backward path.

* * * * *